United States Patent [19]

Ichihara

[11] 4,022,574

[45] May 10, 1977

[54] METHOD FOR TREATING KNITTED FABRICS CONTAINING COTTON FIBERS WITH ALKALI HYDROXIDES

[75] Inventor: Mamoru Ichihara, Kyoto, Japan

[73] Assignee: Daido-Maruta Finishing Co. Ltd., Kyoto, Japan

[22] Filed: May 5, 1975

[21] Appl. No.: 574,558

[30] Foreign Application Priority Data

May 10, 1974 Japan ..... 49-52762

[52] U.S. Cl. ..... 8/125; 8/127; 8/151

[51] Int. Cl.[2] ..... D06M 1/02

[58] Field of Search ..... 8/125, 127, 151

[56] References Cited

UNITED STATES PATENTS

| | | | |
|---|---|---|---|
| 2,678,483 | 5/1954 | Lasley | 8/125 |
| 2,769,685 | 11/1956 | Cowles | 8/151 |
| 3,290,752 | 12/1966 | Ormand | 8/125 |
| 3,449,060 | 6/1969 | Schenck | 8/125 |
| 3,507,609 | 4/1970 | Gorrafa | 8/125 |
| 3,542,503 | 11/1970 | Kullman | 8/125 |
| 3,560,139 | 2/1971 | Suminokura | 8/127 |
| 3,901,014 | 8/1975 | Hiroi | 8/125 |

*Primary Examiner*—Paul R. Michl
*Attorney, Agent, or Firm*—Sherman & Shalloway

[57] ABSTRACT

A method for treating a knitted fabric containing cotton fibers with an alkali hydroxide, which comprises impregnating said fabric with an aqueous solution of an alkali hydroxide while continuously feeding it in the open form in the longitudinal direction, allowing the fabric to shrink in the longitudinal direction, then feeding it to a tenter while giving an overfeed, thereby to hold it to a given width, and then washing the fabric. The knitted cotton fabrics so treated have superior dimensional stability, especially dimensional stability in the widthwise direction, a deep silky luster, a soft bulky hand, and a superior dyeability.

16 Claims, 1 Drawing Figure

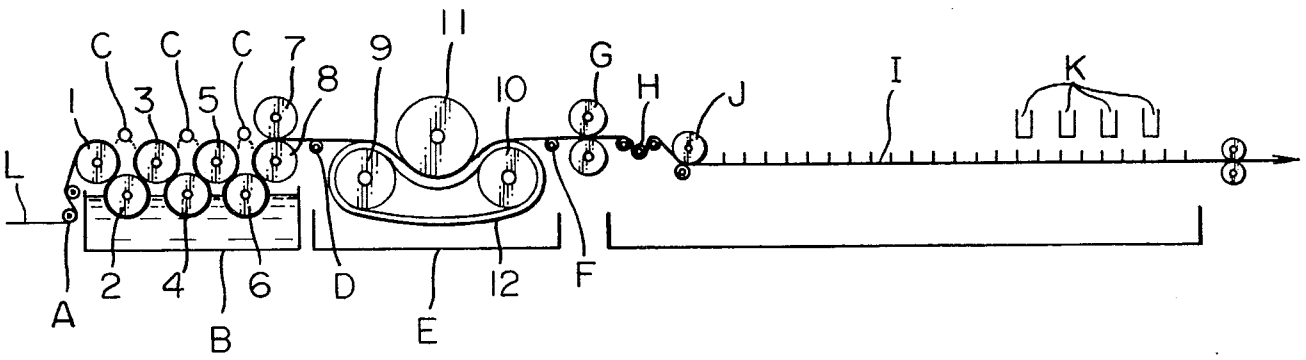
K
I
J
H
G
F
10
12
11
E
9
D
8
7
C
6
5
B
C
4
3
C
2
1
A
L

METHOD FOR TREATING KNITTED FABRICS CONTAINING COTTON FIBERS WITH ALKALI HYDROXIDES

This invention relates to a method for treating knitted fabrics containing cotton fibers with an alkali hydroxide, and more specifically, to a method for providing cotton fiber-containing knitted fabrics having superior dimensional stability especially in the widthwise direction, deep silky luster, bulky feel, and increased dyeability, which comprises treating the knitted fabrics with an alkali hydroxide in the open form, and then subjecting them to a shrinking treatment and a tentering treatment.

Knitted cotton fabrics have frequently been treated with an alkali hydroxide (so-called mercerization) in an attempt to impart luster to the knitted cotton fabrics and improve their dyeability or water absorbability. In the conventional alkali hydroxide treatment of knitted cotton fabrics, the knitted fabrics are treated in a tubular form or in an open form (a sheet form resulting from the slitting of a tubular knitted cotton fabric in the longitudinal direction) using a mercerizing apparatus for cotton woven fabrics which performs the treatment under tension. For this reason, a considerable tension is exerted on the knitted cotton fabrics, and this causes the serious defect that the loop form of the knitted fabrics is deformed, or knitted fabrics having high dimensional stability cannot be obtained. Especially when knitted cotton fabrics are treated in a tubular form with an alkali hydroxide, they are difficult to feed to a tenter, and the resulting product does not get a stable width.

Furthermore, in the mercerization treatment, a sufficient luster cannot be obtained unless a tension is exerted on the fabric during or after immersion of it in an aqueous solution of an alkali hydroxide. Since it is impossible to exert tension on knitted goods because of their inherent properties, the conventional mercerizing treatment of knitted fabrics cannot give cotton knitted fabrics having a high luster effect.

It has therefore been strongly desired to provide a method for alkali hydroxide treatment which can give knitted cotton fabrics having superior dimensional stability and a high luster effect.

We made various studies on the method of alkali hydroxide treatment of knitted cotton fabrics to impart superior dimensional stability and a deep silky luster, and finally found that knitted cotton fabrics meeting the above requirements can be obtained by immersing the knitted cotton fabrics in the open form in an aqueous solution of an alkali hydroxide, subjecting the fabrics to a shrinking treatment, and then feeding them to a tenter while giving them an overfeed.

Accordingly, it is an object of this invention to provide a method for alkali hydroxide treatment of knitted cotton fabrics which can give knitted cotton fabrics having high dimensional stability, especially in the widthwise direction, a deep silky luster and superior dyeability.

Other objects and features of this invention will become apparent from the following description.

According to this invention, there is provided a method for treating a knitted fabric containing cotton fibers with an alkali hydroxide, which comprises impregnating said fabric with an aqueous solution of an alkali hydroxide while continuously feeding it in the open form in the longitudinal direction, allowing the fabric to shrink in the longitudinal direction, then feeding it to a tenter while giving an overfeed thereby to hold it to a given width, and then washing the fabric.

In the present specification and the appended claims, the term "knitted fabrics containing cotton fibers" or "knitted cotton fabrics" denote not only knitted fabrics consisting only of cotton fibers, but also knitted fabrics made of blended yarns of cotton fibers and synthetic fibers and interwoven fabrics made of cotton yarns and synthetic yarns. Examples of the synthetic fibers which can be blended or interwoven with cotton fibers are polyester, polyamide or acrylic synthetic fibers. When such synthetic fibers are contained, the proportion of them in the knitted cotton fabrics is generally not more than 65%, preferably not more than 50%.

In the present invention, the knitted cotton fabrics are treated in the open form, and not in the tubular form. The term "open form" means that the fabric is not in the tubular form. When the knitted cotton fabric is furnished in a tubular form, for example by circular knitting, the fabric is slit in the longitudinal direction and cut and spread to provide the "open form". Knitted cotton fabrics offered in the form of a sheet, such as a warp knit, can be directly treated by the method of this invention in the spread form.

According to the method of this invention, the knitted fabrics containing cotton fibers are impregnated with an aqueous solution of an alkali hydroxide while continuously feeding it in the open form in the longitudinal direction. Sodium hydroxide or potassium hydroxide can be used as the alkali hyroxide. The use of an aqueous solution of sodium hydroxide is most preferred.

The concentration of the alkali hydroxide solution can be varied over a wide range according to the type of the knitted cotton fabric, the hand or luster required of the finished knitted cotton fabric, or the temperature of the alkali hydroxide solution. Generally, the advantageous concentration is 12% to 25% by weight, preferably 14% to 21% by weight.

The alkali hydroxide solution may further contain a penetrant such as a sodium sulfate derivative of 2-ethyl-1-hexanol or an anionic surface active agent.

The temperature of the alkali hydroxide solution at the time of alkali hydroxide treatment can also be varied over a wide range depending upon the type of the knitted cotton fabric, the concentration of the alkali hydroxide solution, and the hand and luster required of the finished knitted fabric. Generally, the temperature is not more than 40° C., and low temperatures of 10° C. or less can also be used. The suitable temperature, however, is 15° C to 35° C. It is not preferred that the temperature of the alkali hydroxide solution changes drastically during treatment, but is is desirable to maintain it within a certain definite range as required using a heat-exchanger, etc.

Impregnation of the fabric with the alkali hydroxide solution can be performed so as to cause the solution to penetrate fully and uniformly into the knitted cotton fabric, by such methods as the immersion of the knitted fabric in the alkali hydroxide solution, the spraying of the alkali hydroxide solution on the knitted fabric or the coating of the alkali hydroxide solution on the knitted fabric.

By such a treatment of impregnating the knitted fabric with the alkali hydroxide solution, the pick-up of the alkali hydroxide can be adjusted generally to 80–120%, preferably to 90–110%.

The knitted cotton fabric impregnated with the alkali hydroxide solution is then subjected to a shrinking treatment. We have found that by this shrinking treatment, the internal stress generated inside the knitted cotton fabric in the step of impregnating the alkali hydroxide solution or any previous step is reduced, and the luster of the finished cotton knit fabric increases remarkably to give a deep silky luster. This discovery is quite unexpected from the common knowledge of the art that in order to increase the luster of a cotton fabric in the conventional mercerizing treatment, a tension must be exerted on the fabric during or after impregnation with the alkali hydroxide solution.

Advantageously, the knitted cotton fabric impregnated with the alkali hydroxide solution is shrunken in the longitudinal direction generally 3% to 15%, preferably 5% to 10%.

The shrinking treatment can be performed at a low temperature such as room temperature, but in order to obtain a sufficient effect, it is preferably carried out at an elevated temperature. The heating temperature is not critical, but suitably, it is generally 80° C to 170° C., preferably 100° C to 150° C.

Heating can be performed for a short period of time which does not lead to the drying of the knitted cotton fabric, and there is no strict restriction on the heating time. Usually, momentary heating for a period of less than 5 seconds, usually 0.5 second to 3 seconds, is sufficient.

Since the main purpose of the shrinking treatment is to impart superior luster, especially a deep silky luster, to the finished cotton knit fabrics, the above shrinking treatment can be omitted when high luster is not required of the finished cotton knit fabrics.

The width of the shrunken cotton knit fabric is then adjusted to a constant width while tentering. The critical feature of the method of this invention is that the knitted cotton fabric is passed through a tenter while overfeeding it, before the strong swelling and shrinking of the fabric with the aqueous alkali hydroxide solution is completed. During treatment on the tenter, the resistance of the fabric to its shrinking in the longitudinal direction is reduced, and the deformation of the loop form of the fabric can be prevented. This results in an improvement of the dimensional stability, especially the dimensional stability in the widthwise direction, and the hand of the knitted cotton fabric finished.

The rate of overfeeding of the knitted cotton fabric to the tenter can be varied over a wide range according to the shrinkage in the shrinking treatment, or the manner of knitting the cotton fabric. Generally, however, the overfeed rate is 2% to 12%, preferably 4% to 8%. The "overfeed rate", as used herein, is calculated from the following equation.

$$\text{Overfeed rate} = \frac{V_s - V_T}{V_T} \times 100$$

wherein $V_s$ is the linear speed of the knitted cotton fabric at the time of feeding it into a tenter, and $V_T$ is the linear speed of the knitted cotton fabric on the tenter.

Any tenter capable of adjusting the width of the knitted cotton fabric shrunken by an alkali hydroxide solution to a constant value can be used. For example, a pin tenter or a clip tenter can be used. The former is especially preferred.

The suitable rate of tentering of the knitted cotton fabric on the tenter is 5% to 10%, preferably 6% to 8%. The rate of tentering is calculated from the following equation:

$$\text{Rate of tentering} = \frac{L_2 - L_1}{L_1} \times 100$$

wherein $L_1$ is the width of the knitted cotton fabric before it is fed to the tenter, and $L_2$ is the width of the knitted cotton fabric after it has been set by the tenter.

The time during which the knitted cotton fabric is held on the tenter can be varied over a wide range according to the alkali treatment conditions, the shrinking treatment conditions, or the type of the knitted cotton fabric, etc. The total time required for the treatment with the aqueous alkali hydroxide solution, the shrinking treatment and a washing treatment to be described hereinbelow can be adjusted to at least 20 seconds. The setting of the width becomes better as the fabric is maintained on the tenter for a longer time, but even when it is maintained there for too long a time, no corresponding merit can be obtained, but the productivity is reduced. Accordingly, the sufficient treating time is usually not more than 1 minute, especially 25 seconds to 40 seconds.

Thus, the swelling and shrinking of the fabric by the impregnated aqueous solution of alkali hydroxide is achieved on the tenter, and the width of the fabric can be set at a constant value.

The knitted cotton fabric is then washed while it is being fed to the tenter, to remove the alkali hydroxide. Washing can usually be performed using water, and in order to remove the alkali hydroxide especially effectively, the use of hot water is preferred. When hot water is used, its temperature is at least 70° C., preferably 85° C to 95° C.

In this washing step, it is desirable to remove the alkali hydroxide from the knitted cotton fabric as completely as possible. Preferably, the washing is continued until the amount of the alkali hydroxide, calculated as a solids content, becomes 2% by weight or less, preferably 1% by weight or less, based on the weight of the knitted cotton fabric.

The knitted cotton fabric so treated is then removed from the tenter, and can be further subjected, if desired, to an ordinary post-treatment. For example, the fabric can further be washed with hot water and cold water, and when it contains a large amount of alkali, neutralized with an aqueous solution of acetic acid or dilute sulfuric acid, etc., further washed with water, and dried.

The method of this invention will be described more specifically by referring to the accompanying drawing which shows the flowsheet of the method of this invention.

Referring to the drawing, a continuous knitted fabric containing cotton fibers L (such as a knitted cotton fabric) is introduced into a treating tank B via an expander A for preventing selvage curling in order to treat it with an alkali hydroxide in the open form. In the treating tank B, an aqueous solution of an alkali hydroxide therein is penetrated into the inside of the fabric while it advances successively along the surfaces of guide rollers 1, 2, 3, 4, 5 and 6. Preferably, the guide rollers 1 to 6 are made of a relatively hard material, and this ensures an intimate adhesion of the fabric to the surfaces of the rollers. Accordingly, a certain tension is exerted on the knitted cotton fabric in the widthwise and longitudinal directions, and the alkali hydroxide solution is penetrated uniformly into the inside of the knitted cotton fabric.

Alternatively, alkali hydroxide solution-spraying showers C may be provided above the guide rollers 1 to 6 in the treating tank B, so that the knitted cotton fabric can be more effectively impregnated with the alkali hydroxide solution.

The knitted cotton fabric impregnated with the alkali hydroxide solution is then squeezed by mangles 7 and 8 to pick-up within the above-specified range, for example, 90% to 110%. The dwell time in the treating tank B is, for example, about 5 seconds. The knitted cotton fabric which has left the treating tank B is immediately sent to a compressive shrinking device E while preventing width shrinking and selvage curling by means of an expander D.

The shrinking treatment in the compressive shrinking device E can be performed by a so-called belt shrinking method wherein the fabric is advanced successively along guide rollers and an endless rubber belt, and thereby a certain shrinking-relaxation is given in the longitudinal direction, and simultaneously, the shrinking in the widthwise direction is restricted. The compressive shrinking device E consists of a pair of rollers 9 and 10, an endless rubber belt 12 hung between the rollers, and a drum 11 placed pressingly on the stretch portion of its top surface. Usually, the rollers 9 and 10 have a diameter of about 30 cm to 35 cm, and the endless rubber belt 12 has a thickness of about 2 cm to 2.5 cm, and a length of about 2.5 m to 3 m. The drum 11 generally has a diameter of 30 cm to 60 cm.

The knitted cotton fabric L first makes contact with the endless rubber belt 12 on the top surface of the roller 9, and after advancing along the surface of the endless rubber belt 12, is fed between the drum 11 and the surface of the belt 12. After passing between them, the knitted cotton fabric L advances along the surface of the endless rubber belt 12 on the surface of the roller 10, and is delivered out. That portion of the surface of the endless rubber belt 12 which makes contact with the top surface of the roller 9 is in the stretched state, whereas that portion of the endless rubber belt 12 which makes contact with the surface of the drum 11 is in the shrunken state. Because of this, the knitted cotton fabric undergoes shrinkage in the longitudinal direction during passage through them. In other words, in the compressive shrinking device E, the knitted cotton fabric shrinks in the longitudinal direction, and the internal stress of the fabric is reduced.

The surface of the drum 11 can be heated to a temperature of, say, 100° C to 150° C. by, for example, passing a high pressure vapor or a heated liquid medium through it so as to promote the shrinking of the knitted cotton fabric, and increase the luster effect further.

Since the knitted cotton fabric is always in contact with the surface of the endless rubber belt or drum 11 during passage through the compressive shrinking device E, the length of the knitted cotton fabric in the widthwise direction is maintained substantially constant. The treating time in the compressive shrinking device E is within the range mentioned above, and, for example, about 2 seconds.

The knitted cotton fabric which has left the compressive shrinking device E is conducted to a tenter I, for example, pin-tenter, after passing through an expander F, a take-out roller G and a selvage opener H. The compressive shrinking device E and the pin-tenter I are interlocked by means of an automatic speed gear (not shown). By the pin-tenter, the knitted cotton fabric is held to the desired width while giving it an overfeed of 2% to 12%, preferably 4% to 8%, to reduce its resistance to shrinkage.

A shrinking device J may be provided at the feeding section of the pin-tenter I so that the knitted cotton fabric can be mounted smoothly on the pins of the pin-tenter.

The set width provided by the pin-tenter is within the range of 5% to 10%, preferably 6% to 8%, larger than the width of the fabric before treatment.

At the rear portion of the pin-tenter I, the knitted cotton fabric is washed by a shower device K to remove the alkali hydroxide remaining in the fabric. This completes the treatment in accordance with this invention. The time required for the knitted cotton fabric to reach shower device K after pinning is preferably about 15 seconds to 20 seconds.

The knitted cotton fabric so treated can be subjected to a known post-treatment(such as washing with cold water and with hot water, neutralization, and drying).

While the method of this invention has been described above by reference to the preferred embodiment shown in the drawing, it is in no way limited thereto, but various changes and modifications are possible within the scope of this invention as is obvious to those skilled in the art.

Thus, the method of this invention provides knitted fabrics containing cotton fibers which has superior dimensional stability, especially dimensional stability in the widthwise direction, a deep silky luster, a soft bulky hand, and a superior dyeability.

The following Examples and Comparative Examples illustrate the method of this invention in greater detail.

In the following Examples and Comparative Examples, the knitted fabric used for mercerization was a tubular plain stitch knitted cotton fabric having a width of 52 cm and consisting of 36 courses/inch and 40 wales/inch which had been prepared by knitting a 30-count single yarn in a texture of 51 courses/inch and 34 wales/inch using a single circular knitting machine with a cylinder diameter of 20 inches and 24 gauges, and scouring and bleaching it to remove impurities.

EXAMPLE 1

The knitted cotton fabric was cut open to have a width of 104 cm, and mercerized by a mercerizing machine of the type shown in the attached drawing. The opened fabric was first conducted to a treating tank (B) containing a 17% by weight aqueous solution of sodium hydroxide at 20° C., and immersed in it for 5 seconds without tension. The fabric was squeezed to a pick-up of 100%, and then immediately fed to a compressive shrinking device E where it was shrunken 5% for 2 seconds while maintaining the surface of the drum at 130° C. The shrunken fabric was then led to a pin-tenter I, and tentered at a tentering rate of 8% to a width of 112 cm while giving an overfeed of 4%. After undergoing a swelling action of the aqueous solution of sodium hydroxide for 20 seconds, the knitted cotton fabric was washed with hot water at 90° C. on the pin-tenter, and then washed with a 0.2% by weight aqueous solution of acetic acid to remove the remaining sodium hydroxide completely. Then, the knitted cotton fabric was passed through a multi-stage pin-tenter-dryer to dry it so that its width became 104 cm. The fabric so treated is designated Sample 1.

EXAMPLE 2

The knitted cotton fabric was cut open to have a width of 104 cm, and mercerized by a mercerizing machine of the type shown in the attached drawing. First, the opened fabric was conducted to a treating tank B containing a 17% by weight aqueous solution of sodium hydroxide at 20° C., and immersed in it for 5 seconds without tension. It was then squeezed to a pick-up of 100%, and immediately led to a compressive shrinking device E where it was shrunken 5% for 2 seconds while maintaining the surface of the drum at 130° C. Then, it was led to a pin-tenter I where it was tentered at a tentering rate of 8% to a width of 112 cm while giving an overfeed of 8%. After undergoing a swelling action of the aqueous solution to sodium hydroxide for 20 seconds, the knitted cotton fabric was washed with hot water at 90° C. on the pin-tenter, and then washed with a 0.2% by weight aqueous solution of acetic acid to remove the remaining sodium hydroxide completely. Then, the knitted cotton fabric was passed through a multi-stage pin-tenter-dryer to dry it so that its width became 104 cm. The fabric so treated is designated Sample 2.

EXAMPLE 3

The knitted cotton fabric was cut open to have a width of 104 cm, and mercerized by a mercerizing machine of the type shown in the attached drawing. First, the opened knitted fabric was conducted to a treating tank B containing a 17% by weight aqueous solution of sodium hydroxide at 20° C., and immersed in it for 5 seconds without tension. It was then squeezed to a pick-up of 100%, and immediately led to a compressive shrinking device E where it was shrunken 10% while maintaining the surface of the drum at 150° C. Then, it was fed to a pin-tenter I where it was tentered at a tentering rate of 8% to a width of 112 cm while giving an overfeed of 4%. After undergoing a swelling action of the aqueous solution of sodium hydroxide for 20 seconds, it was washed with hot water at 90° C. on the pin-tenter, and then washed with a 0.2% by weight aqueous solution of acetic acid to remove the remaining alkali completely. It was then passed through a multi-stage pin-tenter-dryer to dry it so that its width became 104 cm. The knitted fabric so treated is designated Sample 3.

COMPARATIVE EXAMPLE 1

The knitted cotton fabric was mercerized by a conventional chainless mercerizing machine for woven cotton fabrics (a mercerizing machine made by Wakayama Tekko Kabushiki Kaisha, Japan). First, the knitted cotton fabric (in the tubular form with a width of 52 cm) was immersed in a 17% by weight aqueous solution of sodium hydroxide at 20° C. contained in a treating tank for 5 seconds under tension, and then squeezed by a mangle to a pick-up of 100%. Then, similarly under tension, the fabric was treated for 20 seconds in a timing tank attached to the chainless mercerizing machine. During this time, the knitted cotton fabric underwent a swelling and shrinking action by the aqueous solution of sodium hydroxide. Then, the fabric was washed with water at 90° C., and washed with an aqueous solution of acetic acid to remove the remaining sodium hydroxide completely. The knitted cotton fabric so treated in the tubular form was passed through a tenter, and dried by a suction-drum dryer so that the width of the tube became 52 cm. The fabric so treated is designated Sample 4.

COMPARATIVE EXAMPLE 2

The knitted cotton fabric in the tubular form with a width of 52 cm was cut open by a slitting machine and both selvage portions (both end portions) of the knitted cotton fabric were subjected to a gummed selvage treatment to prevent selvage curling. The opened cotton knit fabric with a width of 104 cm was mercerized by a conventional clip tenter-type mercerizing machine for woven cotton fabrics (a mercerizing machine made by Wakayama Tekko Kabushiki Kaisha). First, the opened cotton knit fabric with a width of 104 cm was led to a treating tank comprising three mangles and containing a 17% by weight aqueous solution of sodium hydroxide at 20° C., and immersed in it for 2 seconds under tension. It was then squeezed to a pick-up of 100%. Then, similarly under tension, it was led to a clip tenter, and tentered at a tentering rate of 1% (when the rate was 6%, difficulty was experienced) to a width of 105 cm while it was placed under tension both in the widthwise and longitudinal directions. After undergoing a swelling and shrinking action by the aqueous solution of sodium hydroxide for 20 seconds, the fabric was washed with hot water at 90° C. on the tenter, and then washed with a 0.2% by weight aqeuous solution of acetic acid to remove the remaining sodium hydroxide completely. Then, the fabric so treated was passed through a multi-stage pin-tenter-dryer to dry it so that its width became 104 cm. The resulting fabric is designated Sample 5.

COMPARATIVE EXAMPLE 3

The cotton knitted fabric was cut open to have a width of 104 cm, and mercerized by the same mercerizing machine as used in Example 1 except that the compressive shrinking device E was omitted. First, the opened cotton knit fabric was led to a treating tank B containing a 17% by weight aqueous solution of sodium hydroxide at 20° C, and immersed in it for 5 seconds without tension. It was then squeezed to a pickup of 100%, and immediately led to a pin tenter I where the fabric is tentered at a tentering rate of 8% to a width of 112 cm while feeding it in the longitudinal direction at an overfeed of 6%. After undergoing a swelling-shrinking action of the aqueous solution of sodium hydroxide for 20 seconds, the fabric was washed with hot water at 90° C. by a shower device K on the pin tenter, and then with a 0.2% by weight aqueous solution of acetic acid to remove the remaining sodium hydroxide completely. Then, the treated fabric was passed through a multi-stage pin-tenter-dryer to dry it so that its width became 104 cm. The fabric so treated is designated Sample 6.

COMPARATIVE EXAMPLE 4

The knitted cotton fabric was cut open to have a width of 104 cm, and mercerized by a mercerizing machine of the type shown in the attached drawing with giving any overfeed. First, the opened knitted fabric was led to a treating tank B containing a 17% by weight aqueous solution of sodium hydroxide at 20° C., and immersed in it for 5 seconds without tension. It was then squeezed to a pick-up of 100%, and then immediately conducted to a compressive shrinking device E where it was shrunken 7% for 2 seconds while maintaining the surface of the drum at 130° C. Then, the fabric was led to a pin-tenter I, and tentered at a tentering rate of 8% to a width of 112 cm while giving no tension. After undergoing a swelling action of the aqueous solution of sodium hydroxide for 20 seconds, the knitted cotton fabric was washed with hot water at 90° C. by a shower device K on the pin-tenter, and then washed with a 0.2% by weight aqueous solution of acetic acid to remove the remaining sodium hydroxide completely. The fabric so treated was passed through a multi-stage pin-tenter-dryer to dry it so that its width became 104 cm. The resulting fabric is designated Sample 7.

The quality of each of the Samples 1 to 7 was examined, and the results are tabulated below. In the table, the shrinking on washing, the barium activity number and the luster were determined by the following methods.

a. Shrinkage on washing (%)

Determined in accordance with AATCC Test Method 135–1973.

Test procedure:

Washing — 41° C ± 3° C. for 12 min.

Drying — Line dry b. Barium activity number

Determined in accordance with AATCC Test Method 89–1971.

c. Luster

Determined in accordance with the Jeffries method described in R. Jeffries, T. Text., Inst., 46, 391 (1955).

| Samples | Shrinkage (%) on washing Wale | Shrinkage (%) on washing Course | Barium activity number | Luster | Appearance of the knitted fabric |
|---|---|---|---|---|---|
| | 2.0 | 2.5 | 135 | 1.80 | Superior luster, and the knitted fabric presents bulkiness |
| 2 | 1.0 | 2.5 | 137 | 1.79 | " |
| 3 | 1.5 | 3.0 | 135 | 1.81 | " |
| 4 | 3.0 | 6.0 | 135 | 1.76 | Hard creases occurred on both selvages, and the knitted fabric is devoid of bulkiness |
| 5 | 3.4 | 7.5 | 125 | 1.70 | The shape of loops is elongated in the longitudinal direction; the knitted fabric is devoid of bulkiness and the knitted texture is non-uniform |
| 6 | 4.0 | 2.5 | 130 | 1.68 | The knitted fabric has bulkiness but the luster is poor |
| 7 | 5.0 | 5.0 | 135 | 1.74 | The luster is poor, and the knitted fabric is devoid of bulkiness |

The above results demonstrate that the method of this invention provides knitted fabrics having good shrinkage on washing, good dimensional stability in the widthwise direction, a deep silky luster, and bulkiness.

What we claim is:

1. A method for continuously treating a knitted fabric containing cotton fibers with an alkali hydroxide to improve the dimensional stability thereof, which comprises a. impregnating said fabric with an aqueous solution of an alkali hydroxide while feeding it in the open form in the longitudinal direction;

b. subjecting the impregnated fabric from step (a) to a compressive shrinking operation in the longitudinal direction while restricting the shrinkage in the widthwise direction;

c. then before the strong swelling and shrinking of the fabric with the aqueous alkali hydroxide solution are completed, feeding the resulting fabric from step (b) to a tenter while giving an overfeed; thereby to hold it to a given width; and d. washing the fabric while maintaining it on the tenter.

2. The method of claim 1, wherein said impregnated fabric is shrunken 3% to 15% in the longitudinal direction by said compressive shrinking operation of step (b).

3. The method of claim 1, wherein the compressive shrinking operation of step (b) is carried out at an elevated temperature.

4. The method of claim 3, wherein said elevated temperature is 80° C to 170° C.

5. The method of claim 1, wherein said compressive shrinking operation of step (b) is carried out by a belt shrinking method.

6. The method of claim 1, wherein said overfeed in step (c) is 2% to 12%.

7. The method of claim 1, wherein said resulting fabric from step (b) is fed to the tenter at a tentering rate of 5% to 10%.

8. The method of claim 1, wherein said washing step (d) is carried out using water kept at a temperature of at least 70° C.

9. The method of claim 1, wherein said alkali hydroxide is sodium hydroxide.

10. The method of claim 1 wherein said fabric is impregnated in step (a) with an aqueous solution containing 12% to 25% by weight of an alkali hydroxide selected from sodium hydroxide and potassium hydroxide at a temperature in the range of 10° C to 40° C at a pick-up of the alkali hydroxide in the range of 80°–120%.

11. The method of claim 1 wherein said impregnated fabric is shrunken 5% to 10% in the longitudinal direction by the compressive shrinking operation of step (b).

12. The method of claim 3 wherein said elevated temperature is 100° C to 150° C.

13. The method of claim 1 wherein said overfeed in step (c) is 4% to 8%.

14. The method of claim 1 wherein said resulting fabric from step (b) is fed to the tenter at a tentering rate of 6% to 8%.

15. The method of claim 1 wherein the total time of step (c) and (d) during which said fabric is held on said tenter is 20 seconds to 1 minute.

16. The method of claim 1 wherein said washing step (d) is carried out at a temperature of 80° C to 95° C.

* * * * *

UNITED STATES PATENT AND TRADEMARK OFFICE

CERTIFICATE OF CORRECTION

PATENT NO. : 4,022,574

DATED : May 10, 1977

INVENTOR(S) : MAMORU ICHIHARA

It is certified that error appears in the above-identified patent and that said Letters Patent are hereby corrected as shown below:

Claim 10, line 7, delete "80°", insert -- 80 --

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*